US009045934B1

(12) United States Patent
Lynch et al.

(10) Patent No.: US 9,045,934 B1
(45) Date of Patent: Jun. 2, 2015

(54) DEVICES AND SYSTEMS FOR ACCUMULATING LIFT CORDS USED TO LIFT ARCHITECTURAL OPENING COVERINGS

(71) Applicant: SAFE-T-SHADE, Huntersville, NC (US)

(72) Inventors: William Lynch, Cornelius, NC (US); William D. Feather, Salisbury, NC (US); Steve Gibbons, Waxhaw, NC (US); Tim Wood, Stony Point, NC (US)

(73) Assignee: SAFE-T-SHADE, Huntersville, NC (US)

( * ) Notice: Subject to any disclaimer, the term of this patent is extended or adjusted under 35 U.S.C. 154(b) by 0 days.

(21) Appl. No.: 14/312,432

(22) Filed: Jun. 23, 2014

(51) Int. Cl.
*E06B 9/06* (2006.01)
*E06B 9/322* (2006.01)

(52) U.S. Cl.
CPC ..... *E06B 9/322* (2013.01)

(58) Field of Classification Search
USPC ..... 160/84.01, 84.04, 84.05, 170, 171, 190, 160/193
IPC ..... E06B 9/06,2009/06, 2009/2622, 2009/3227
See application file for complete search history.

(56) References Cited

U.S. PATENT DOCUMENTS

| | | | | | |
|---|---|---|---|---|---|
| 2,765,030 | A * | 10/1956 | Bechtler | ..... | 160/170 |
| 4,623,012 | A * | 11/1986 | Rude et al. | ..... | 160/243 |
| 5,103,888 | A * | 4/1992 | Nakamura | ..... | 160/171 |
| 5,133,399 | A * | 7/1992 | Hiller et al. | ..... | 160/171 |
| 5,515,898 | A * | 5/1996 | Alcocer | ..... | 160/84.02 |
| 5,791,390 | A | 8/1998 | Watanabe | | |
| 6,032,716 | A | 3/2000 | Mattey | | |
| 6,622,769 | B2 * | 9/2003 | Judkins | ..... | 160/84.05 |
| 6,854,503 | B2 | 2/2005 | Cross et al. | | |
| 6,964,291 | B2 * | 11/2005 | Judkins | ..... | 160/170 |
| 7,137,430 | B2 | 11/2006 | Fraczek | | |
| 7,178,577 | B2 * | 2/2007 | Liu | ..... | 160/170 |
| 7,624,785 | B2 * | 12/2009 | Yu et al. | ..... | 160/171 |
| 8,025,089 | B2 * | 9/2011 | Chelednik et al. | ..... | 160/170 |
| 8,540,006 | B1 | 9/2013 | Vestal et al. | | |
| 2007/0000618 | A1 * | 1/2007 | Ng et al. | ..... | 160/84.01 |
| 2007/0125501 | A1 * | 6/2007 | Liang | ..... | 160/84.01 |
| 2007/0277936 | A1 * | 12/2007 | Sirkin | ..... | 160/84.01 |
| 2008/0083512 | A1 * | 4/2008 | Hsu | ..... | 160/170 |
| 2008/0251624 | A1 * | 10/2008 | Fraczek et al. | ..... | 242/389 |

* cited by examiner

*Primary Examiner* — David Purol
(74) *Attorney, Agent, or Firm* — Withrow & Terranova, PLLC

(57) ABSTRACT

An apparatus for accumulating one or more lift cords used to lift an architectural opening covering comprises a base portion and a front portion having a diameter larger than a diameter of the base portion. The base portion has an opening configured to receive a rod that rotates in a first direction when the one or more lift cords are actuated to raise the architectural opening covering. The apparatus also comprises an outer surface having a plurality of grooves configured to receive at least one of the one or more lift cords when the one or more lift cords are actuated to raise the architectural opening covering and to allow the at least one of the one or more lift cords to accumulate on one or more of the plurality of grooves next to itself rather than on top of itself.

24 Claims, 9 Drawing Sheets

DEVICES AND SYSTEMS FOR ACCUMULATING LIFT CORDS USED TO LIFT ARCHITECTURAL OPENING COVERINGS

RELATED APPLICATIONS

This application is related to commonly owned U.S. patent application Ser. No. 13/738,387, filed Jan. 10, 2013, entitled "Apparatuses, Systems and Methods for Locking Lift Cords Used to Lift Architectural Opening Coverings,", now U.S. Pat. No. 8,540,006, which is incorporated herein by reference in its entirety.

This application is also related to co-pending U.S. patent application Ser. No. 12/976,732, filed Dec. 22, 2010, entitled "Cordless Covering for Architectural Opening", which is incorporated herein by reference in its entirety.

This application is also related to co-pending U.S. patent application Ser. No. 12/976,677, filed Dec. 22, 2010, entitled "Architectural Cover Operating Assembly,", which is incorporated herein by reference in its entirety.

This application is also related to co-pending U.S. patent application Ser. No. 13/035,222, filed Feb. 25, 2011, entitled "Cordless Blind System and Retro-Fit Method", which is incorporated herein by reference.

This application is also related to co-pending U.S. patent application Ser. No. 13/094,705, filed Apr. 26, 2011, entitled "Cordless Blind Systems Having Cord Enclosures with a Swivel Feature and Methods of Assembling Such Cord Enclosures", which is incorporated herein by reference.

This application is also related to co-pending U.S. patent application Ser. No. 13/094,727, filed Apr. 26, 2011, entitled "Cordless Coverings for Architectural Opening having Cord Enclosures with a Swivel Feature and Methods of Assembling Such Cord Enclosures", which is incorporated herein by reference.

FIELD OF THE DISCLOSURE

Embodiments disclosed herein include coverings for architectural openings and lift systems to raise and lower such coverings, and in particular to devices and systems for accumulating lift cords, particularly lift cords used for raising and lowering coverings for architectural openings.

BACKGROUND

In the use of window and architectural passage coverings, the art has long relied on cords, string or the like to extend and retract the coverings. Such coverings take many forms, including shades such as curtains, roll-up shades, Venetian blinds, vertical blinds, cellular shades, and the like. The problem with such coverings that rely on cords is that small children can become entangled in the cords and experience serious harm, including strangulation and death. On Aug. 26, 2009, the U.S. Consumer Product Safety Commission announced a voluntary recall of all ¼ inch Oval Roll-up Blinds and Woolrich Roman Shades, including some 4.2 million roll-up blinds and 600,000 Roman shades, (www.cpsc.gov/cpscpub/prerel/prhtml09/09324.html). The U.S. Consumer Product Safety Commission referenced the hazard that "[s]trangulations can occur if the lifting loops slide off the side of the blind and a child's neck becomes entangled on the free-standing loop or if a child places his/her neck between the lifting loop and the roll-up blind material." Recent cited injuries include a report that "[i]n November 2007, a 1-year-old boy from Norridgewock, Me. became entangled and strangled in the lift cord loop of a roll-up blind that had fallen into his portable crib. In October 2008, a 13-month-old boy from Conway, Ark. was found with his head between the exposed inner cord and the cloth on the backside of a Roman shade. The cord was not looped around the boy's neck but rather ran from ear to ear and strangled the child." Numerous manufacturers and retailers have followed their call to recall dangerous blinds and shades. Additional information may be found at: (www.windowcoverings.org).

In addition to the internal cords attached to the shade or blinds that can be pulled out and pose a problem, the pull cords, string and beaded cords in mechanical based blinds and shades that are pulled on to draw up the blinds or shades also pose a risk since they also create a hazardous loop of sufficient diameter twelve (12) inches per the Consumer Product Safety Commission) for a small child to get their head tangled inside. Some industry standards consider a loop of seven and one half (7.5) inches to be hazardous. Even the retrofit devices currently available (www.windowcoverings.org/how_to_retrofit.html) do not eliminate the hazardous loops created by the beaded cords even if they are tied to the wall with a tie-down device such as a Rollease™ product or with separated draw strings and/or cord stops that could still become tangled together to create a hazardous loop.

Further, the cords used to lift the window coverings often get entangled upon themselves during operation such that the window covering cannot be smoothly and properly raised and lowered.

In consequence, the art is in need of improvement in coverings for architectural openings that maintains the functionality and aesthetics of previously developed coverings, but avoids their deficiencies, particularly their hazardous character as regards to the risk of injury or death associated with the use of cord arrangements. The art also is in need of a new mechanism to allow the lifting of shades without creating a hazardous loop. Further, it is desirable to have a mechanism to allow the cord used to lift and lower the covering for an architectural opening to be accumulated without entanglement to safely and smoothly raise a window covering.

SUMMARY

Embodiments disclosed in the present Specification relate to apparatuses for accumulating one or more lift cords used to lift an architectural opening covering. An explemary apparatus comprises a base portion having an opening disposed therein, the opening configured to receive a rod that rotates in a first direction when the one or more lift cords are actuated to raise the architectural opening covering. The apparatus also comprises a front portion having a diameter larger than a diameter of the base portion such that the diameter of the apparatus narrows from the front portion to the base portion. The apparatus further comprises an outer surface having a plurality of grooves. The plurality of grooves are configured to receive at least one of the one or more lift cords when the one or more lift cords are actuated to raise the architectural opening covering and to allow the at least one of the one or more lift cords to accumulate on one or more of the plurality of grooves next to itself rather than on top of itself.

In another embodiment, systems for accumulating one or more lift cords used to lift an architectural opening covering are disclosed. An exemplary system comprises a head rail, an architectural opening covering attached to the head rail, and one or more lift cords configured to lift the architectural opening covering. The system also comprises a rod having a first end and a second end positioned under the head rail. The system further comprises one or more accumulating members configured to be positioned on the rod. The one or more accumulating members each has an outer surface having a plurality of grooves configured to receive at least one of the one or more lift cords when the one or more lift cords are actuated to raise the architectural opening covering and to allow the at least one of the one or more lift cords to accumulate on one or more of the plurality of grooves next to itself rather than on top of itself.

In this manner, by use of the apparatuses and systems disclosed herein, lift cords used to raise and lower the covering for an architectural opening can be accumulated without entanglement so that the window covering can be safely and smoothly raised and lowered. In addition, because the accumulating members allow for a smooth and efficient accumulating of the lift cords, window openings may be raised and lowered without creating a hazardous loop.

Other aspects, features and embodiments will be more fully apparent from the ensuing disclosure and appended claims.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this Specification illustrate several aspects of the disclosure, and together with the description serve to explain the principles of the disclosure.

DETAILED DESCRIPTION

Figure 1A:
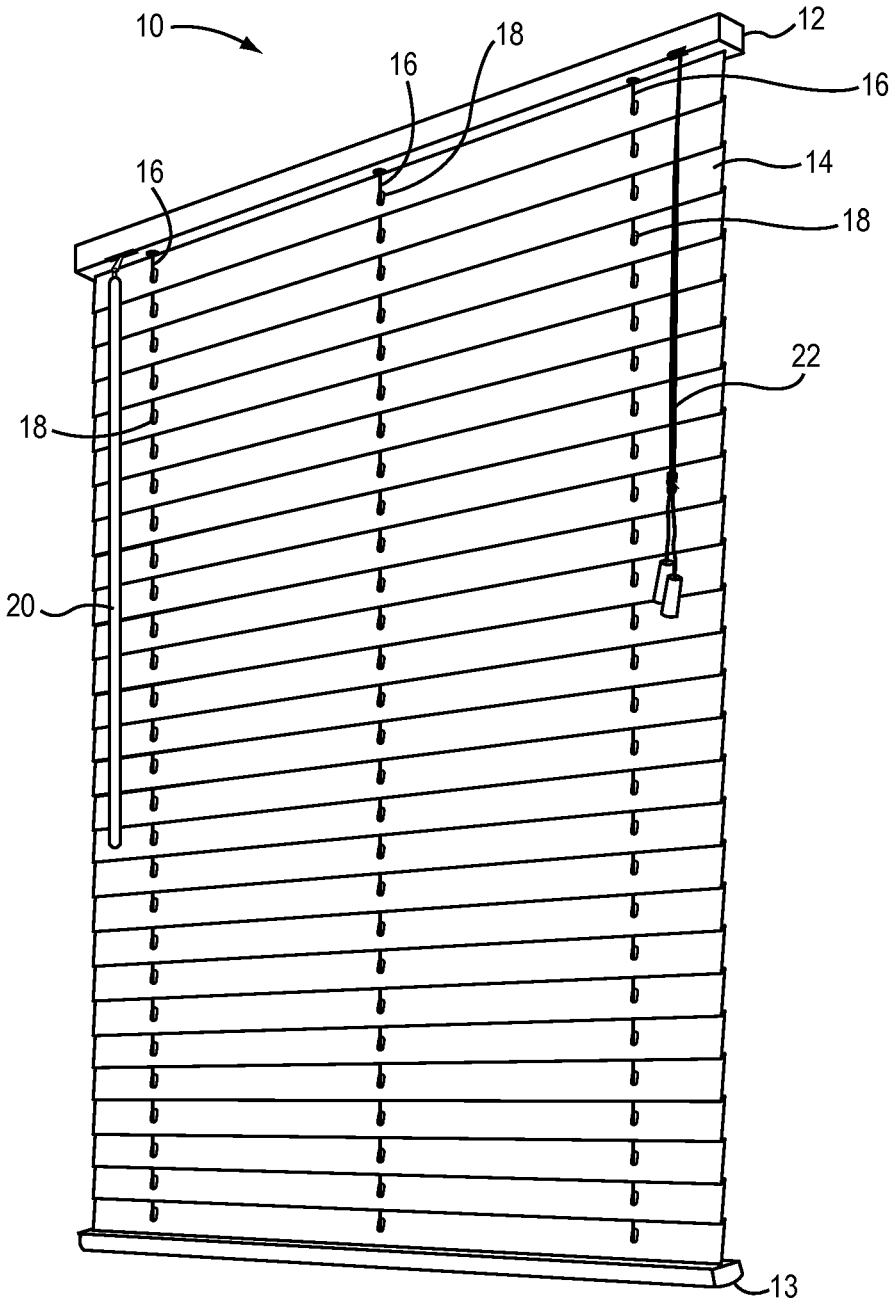
FIG. 1A (PRIOR ART)
FIG. 1A is a representative view of a prior art architectural opening covering system comprised of blinds that uses lift cords.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Embodiments disclosed in the present Specification relate to apparatuses for accumulating one or more lift cords used to lift an architectural opening covering. An exemplary apparatus comprises a base portion having an opening disposed therein, the opening configured to receive a rod that rotates in a first direction when the one or more lift cords are actuated to raise the architectural opening covering. The apparatus also comprises a front portion having a diameter larger than a diameter of the base portion such that the diameter of the apparatus narrows from the front portion to the base portion. The apparatus further comprises an outer surface having a plurality of grooves. The plurality of grooves are configured to receive at least one of the one or more lift cords when the one or more lift cords are actuated to raise the architectural opening covering and to allow the at least one of the one or more lift cords to accumulate on one or more of the plurality of grooves next to itself rather than on top of itself.

In another embodiment, systems for accumulating one or more lift cords used to lift an architectural opening covering are disclosed. An exemplary system comprises a head rail, an architectural opening covering attached to the head rail, and one or more lift cords configured to lift the architectural opening covering. The system also comprises a rod having a first end and a second end positioned under the head rail. The system further comprises one or more accumulating members configured to be positioned on the rod. The one or more accumulating members each has an outer surface having a plurality of grooves configured to receive at least one of the one or more lift cords when the one or more lift cords are actuated to raise the architectural opening covering and to allow the at least one of the one or more lift cords to accumulate on one or more of the plurality of grooves next to itself rather than on top of itself.

In this manner, by use of the apparatuses and systems disclosed herein, lift cords used to raise and lower the covering for an architectural opening can be accumulated without entanglement so that the window covering can be safely and smoothly raised and lowered. In addition, because the accumulating members allow for a smooth and efficient accumulating of the lift cords, window openings may be raised and lowered without creating a hazardous loop.

The advantages and features of the embodiments disclosed herein are further illustrated with reference to the following disclosure, which is not to be construed as in any way limiting the scope of the invention but rather as illustrative of the invention in a specific application thereof.

FIG. 1A is a representative view of a prior art architectural opening covering system comprised of blinds that uses lift cords. An architectural opening covering system 10 comprises a head rail 12 for attaching to or above a window, door, portal, or other architectural opening, and a bottom rail 13.

The architectural opening covering system 10 also comprises a plurality of blind members 14 connected to the head rail 12 by means of a plurality of lift cords 16, which run through openings 18 in the blind members 14. The blind members 14 may be made of any suitable material, including but not limited to fabric, wood, or plastic. The lift cords 16 are attached to the head rail 12 and to the bottom rail 13 and are configured to lift the blind members 14 when actuated. The lift cords 16 may be actuated by any known method. The architectural opening covering system 10 may further comprise a tilt bar 20 for tilting the blind members 14 and a lift portion 22 of the lift cords 16, which may be used to lift and lower the blind members 14.

Figure 1B:
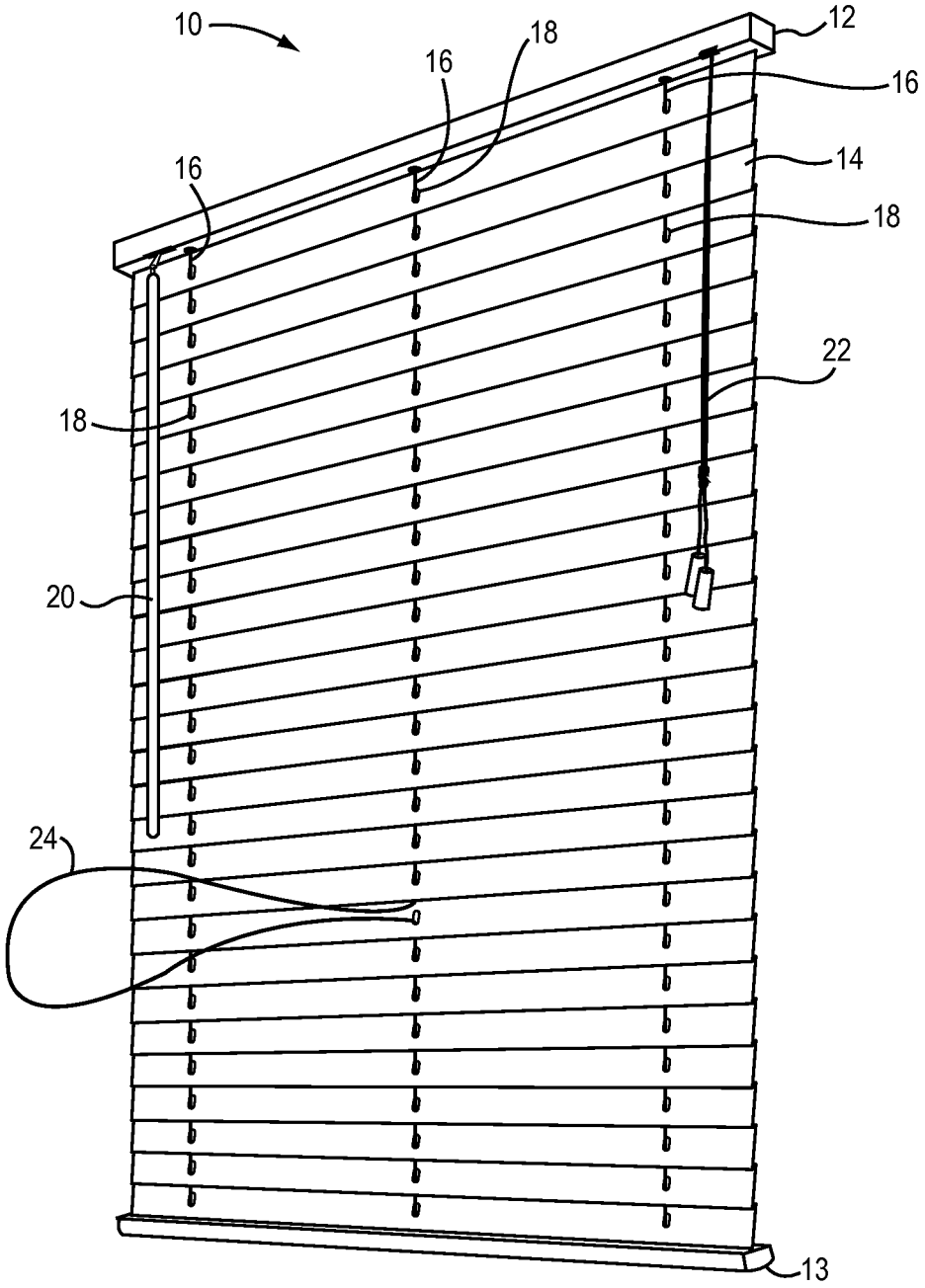
FIG. 1B (PRIOR ART)
FIG. 1B is a representative view of the prior art architectural opening covering system of FIG. 1A illustrating how hazardous loops can be formed by the lift cords of the prior art.

FIG. 1B is a representative side view of the prior art architectural opening covering system of FIG. 1A illustrating how hazardous loops can be formed by the lift cords of the prior art. Due to the slack necessary to allow the lift cords 16 to raise and lower the blind members 14 in the prior art architectural opening covering system 10, the lift cords 16 may be able to be pulled out away from the blind members 14 to a distance that allows a hazardous loop 24 to be formed. A loop is considered to be a hazardous loop per the Consumer Product Safety Commission when the loop has a diameter of approximately twelve (12) inches, sufficient for a small child to get their head tangled inside. Some industry standards consider a loop of approximately seven and one half (7.5) inches to be hazardous. The art is therefore in need of systems and methods to allow the lifting of shades without creating a hazardous loop by the lift cords. In one embodiment, the loop should be smaller than the listed diameters when approximately ten (10 pounds) of push force or approximately five (5) pounds of pull force is exerted on the lift cord.

In addition, due to the slack necessary to allow the lift cords 18 to raise and lower the blind members 14 in the prior art architectural opening covering system 10, the lift cords 16 may also get entangled upon themselves or the blind members 14. The architectural opening covering system 10 is raised and lowered with at least one lift cord 16 (or lift portion 22) that is retrieved upward in such a manner that a bottom of the architectural opening covering system 10 raises upward, and the architectural opening covering system 10 lowers by reversing the lift action. Often, due to the slack necessary to allow the lift cords 16 to raise and lower the blind members 14 in the prior art architectural opening covering system 10 get entangled upon themselves or the blind members 14 and interrupts the action necessary to raise or lower the architectural opening covering system 10 smoothly and safely. For example, the architectural opening covering system 10 may not be able to be lowered and/or raised at all, or it may be lowered or raised only on one side, causing the architectural opening covering system 10 to become crooked.

Figure 2A:
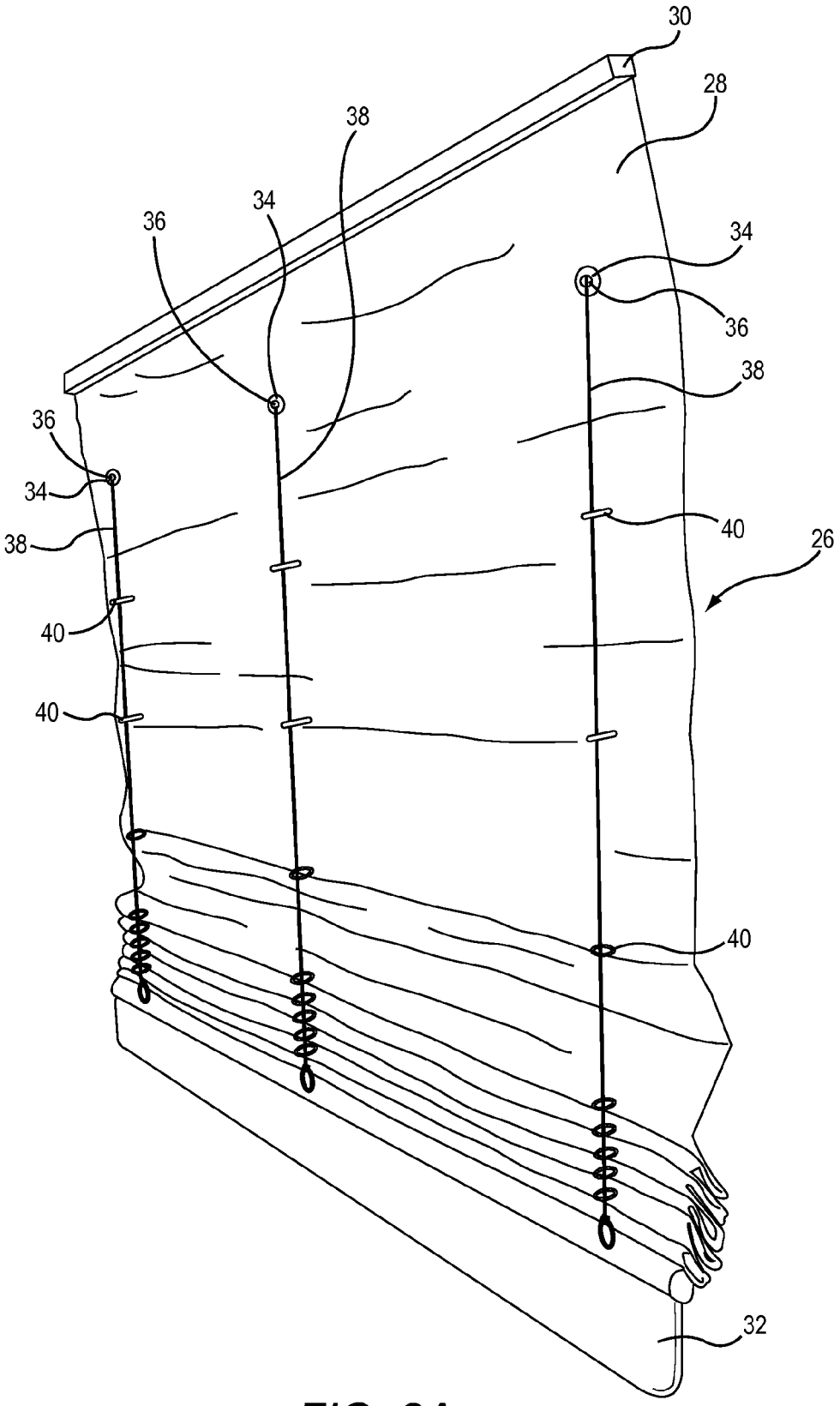
FIG. 2A (PRIOR ART)
FIG. 2A is a representative view of a prior art architectural opening covering system comprised of a shade with rings attached to the shade, with lift cords running through the rings attached to the shade.

FIG. 2A is a representative view of a prior art architectural opening covering system 26 comprised of a shade 28 attached to a head rail 30 and a lift bar 32. In one embodiment, the shade 28 may comprise a lift sheet material with a decorative shade material behind it. The head rail 30 is used for attaching to or above a window, door, portal, or other architectural opening. The head rail 30 is preferably attached at the top of the architectural opening so that gravity can aid in lowering the covering or shade 28 over the opening. One end of the shade 28 is preferably attached to the head rail 30, and another end of the shade 28 is affixed or engaged in some way to a lift bar 32. The shade 28 may be affixed or engaged to the head rail 30 and the lift bar 32 in any suitable manner, such as with magnetic strips, Velcro® hook and loop fastener members, adhesive, stitching, or a pocket for collecting the lift bar 32 attached to the shade 28. The shade 28 can be any woven or non-woven material, fabric, or the like.

The shade 28 has grommets 34 surrounding openings 36 for one or more lift cords 38 to pass through the openings 36. The lift cords 38 are attached to the head rail 30 and to the lift bar 32 and are configured to lift the shade 28 when actuated. The lift cords 38 may be actuated by any known method, including a roller or crank mechanism (not shown). The shade 28 may also have one or more guide rings 40 that the lift cord 38 passes through to aid in the rising and lowering of the shade 28. The guide rings 40 allow the lift cord 38 to pass through as the lift cord 38 moves to raise or lower the shade 28. As the shade 28 is drawn upwards by the lift cord 38 passing through the guide rings 40, the guide rings 40 stack on top of each other and raise the shade 28 upwardly into folded layers stacked in an accordion fashion (see bottom of FIG. 2A). As pictured in FIG. 2A, there are three lift cords 38 and three rows of guide rings 40, with eight guide rings in each row. However, depending on the size and type of architectural opening covering system, any number of lift cords 38 may be used, with any number of rows and any number of guide rings in each row.

Figure 2B:
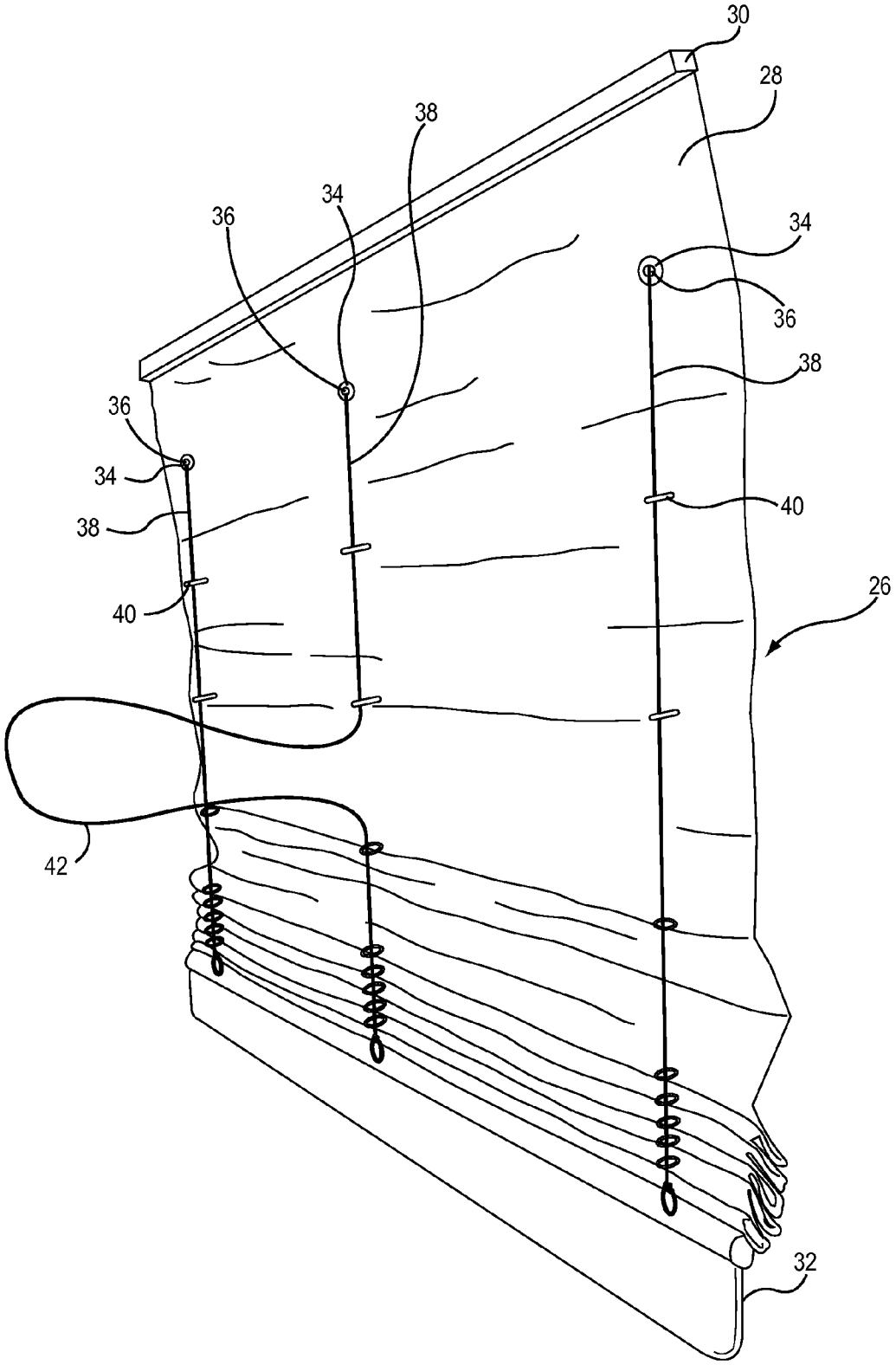
FIG. 2B (PRIOR ART)
FIG. 2B is a representative view of the prior art architectural opening covering system of FIG. 2A illustrating how hazardous loops can be formed by the lift cords of the prior art.

FIG. 2B is a representative side view of the prior art architectural opening covering system 26 of FIG. 2A illustrating how hazardous loops can be formed by the lift cords of the prior art. Due to the slack necessary to allow the lift cords 38 to raise and lower the shade 28 in the prior art architectural opening covering system 26, the lift cords 38 may be able to be pulled out away from the shade 28 to a distance that allows a hazardous loop 42 to be formed. A loop is considered to be a hazardous loop per the Consumer Product Safety Commission when the loop has a diameter of approximately twelve (12) inches, sufficient for a small child to get their head tangled inside. Some industry standards consider a loop of approximately seven and one half (7.5) inches to be hazardous. The art is therefore in need of systems and methods to allow the lifting of shades without creating a hazardous loop by the lift cords. In one embodiment, the loop should be smaller than the listed diameters when approximately ten (10 pounds) of push force or approximately five (5) pounds of pull force is exerted on the lift cord.

In addition, due to the slack necessary to allow the lift cords 38 to raise and lower the shade 28 in the prior art architectural opening covering system 26, the lift cords 38 may also get entangled upon themselves. The shade 28 is raised and lowered with at least one lift cord 38 that is retrieved upward in such a manner that a bottom of the shade 28 raises upward, and the shade 28 lowers by reversing the lift action. Often, due to the slack necessary to allow the lift cords 38 to raise and lower the shade 28, the lift cords 38 get entangled upon themselves and interrupts the action necessary to raise or lower the shade 28 smoothly and safely. For example, the shade 28 may not be able to be lowered and/or raised at all, or it may be lowered or raised only on one side, causing the shade 28 to become crooked.

Figure 3:
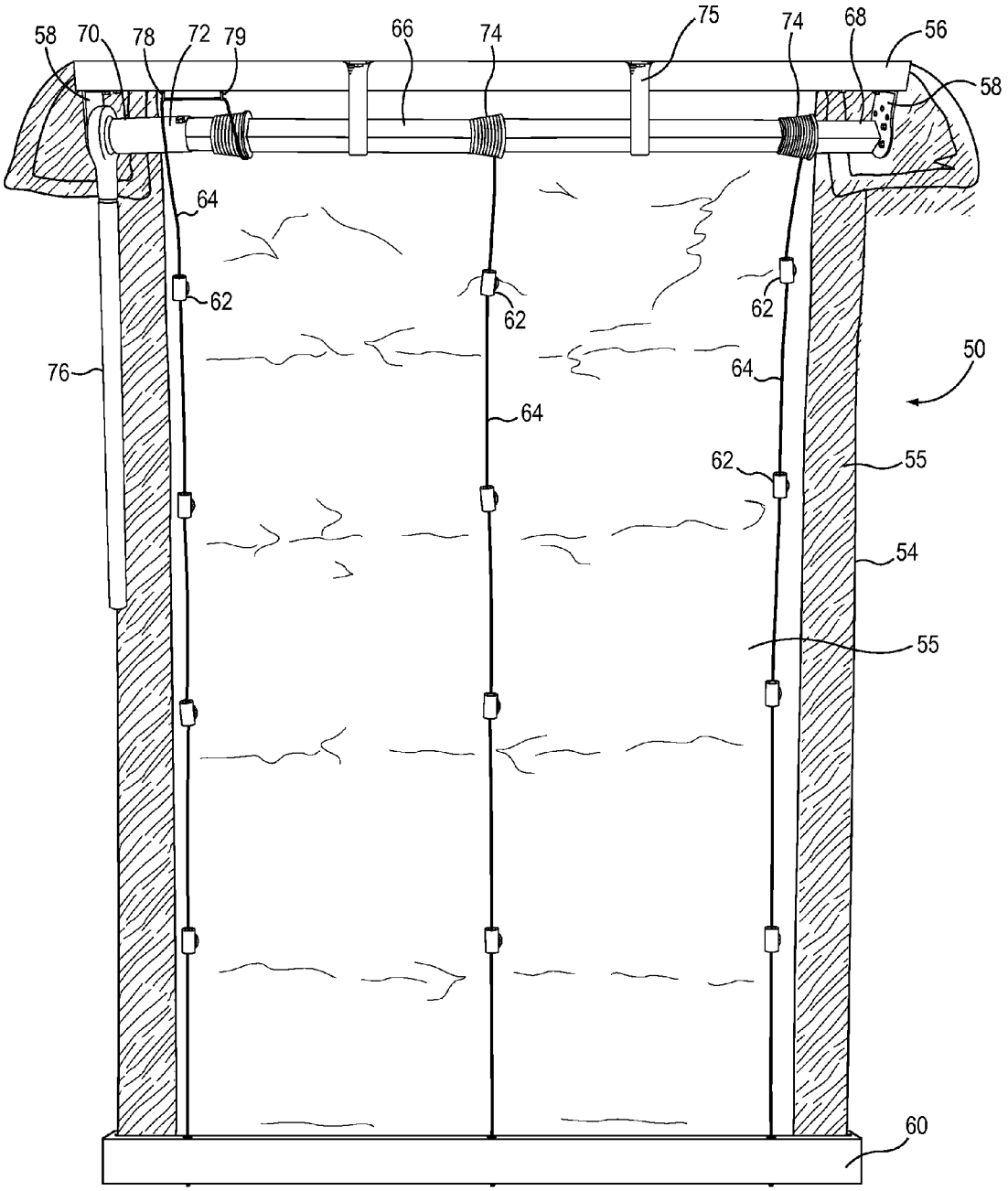
FIG. 3 is a representative view of an exemplary system including a plurality of accumulating members for accumulating a cord used to lift and lower a covering for an architectural opening without entanglement to safely and smoothly raise a window covering, according to one embodiment.

FIG. 3 is a representative view of an exemplary system including a plurality of accumulating members for accumulating a cord used to lift and lower a covering for an architectural opening without entanglement to safely and smoothly raise a window covering, according to one embodiment. An exemplary architectural opening covering system 50 comprises a shade 54 attached to a head rail 56. In one embodiment, the head rail 56 may include brackets 58 at each end of the head rail 56. The brackets 58 may be integral to the head rail 56 or they may be attached to the head rail 56 by any conventional means. The shade 54 may comprise a lift sheet material 53 with a decorative shade material 55 behind it. The head rail 56 is used for attaching to or above a window, door, portal, or other architectural opening. The head rail 56 is preferably attached at the top of the architectural opening so that gravity can aid in lowering the covering or shade 54 over the opening. One end of the shade 54 is preferably attached to the head rail 56 at one end, and another end of the shade 54 is affixed or engaged in some way to a lift bar 60 at another end. The shade 54 may be affixed or engaged to the head rail 56 and the lift bar 60 in any suitable manner, such as with magnetic strips, Velcro® hook and loop fastener members, adhesive, stitching, or a pocket for collecting the lift bar 60 attached to the shade 54. The shade 54 can be any woven or non-woven material, fabric, or the like.

A plurality of guide members 62 may be attached to the shade 54, and in one embodiment may be attached to the lift sheet material 53. The guide members 62 may take various forms. In one embodiment, they can be guide rings like guide rings 40 in FIGS. 2A and 2B. In another embodiment, the guide members 62 can be in the form of tubes. In yet another embodiment, the guide members 62 can include a guide member in conjunction with a locking member, as disclosed in U.S. Pat. No. 8,540,006, which is commonly owned and assigned to the assignee of the present application. The guide members 62 may be made of any suitable material, including but not limited to plastic, wood, or metal, including but not limited to brass. In addition, the guide members 62 may have any suitable shape, including but limited to circular, square, rectangular, tubular, or D-shaped guide rings. The guide members 62 may have any suitable thickness, and any suitable diameter.

A plurality of lift cords 64 pass through the guide members 62 and are configured to lift the shade 54 when actuated. The lift cords 64 may be actuated by any known method, including a roller or crank mechanism. The lift cords 64 pass through the guide members 62 to aid in the raising and lowering of the shade 54. The guide members 62 allow the lift cords 64 to pass through as the lift cords 64 move to raise or lower the shade 54. As the shade 54 is drawn upwards by the lift cords 64 passing through the guide members 62, the guide members 62 may stack on top of each other and raise the shade 54 upwardly into folded layers stacked in an accordion fashion. Depending on the size and type of architectural covering, any number of lift cords 64 may be used, with any number of rows and any number of guide members 62 in each row.

Still referring to FIG. 3, a rod 66 having a first end 68 and a second end 70 is positioned underneath the head rail 56. In one embodiment, the rod 66 is connected to the brackets 58 that are integral to or connected to the head rail 56. The rod 66 may provide a mechanism for accumulating the lift cords 64 as the shade 54 is raised and lowered. In one embodiment, one or more support brackets 75 are attached to the head rail 56 and support the rod 66. The support brackets 75 may be u-shaped, c-shaped, j-shaped, horseshoe-shaped, or any other shape that allows the rod 66 to sit upon the bracket 75. In one embodiment, a sleeve 72 may be fitted over the rod 66 to allow for the connecting of a roller mechanism 76 to the second end 70 of the rod 66. In another embodiment, the roller mechanism 76 may fit directly on to the second end 70 of the rod 66. In one embodiment, the roller mechanism 76 may include a wand with a clutch mechanism and a continuous beaded chain to actuate the rod 66 to rotate the rod 66 such that the lift cords 64 are actuated and the shade 54 is lifted or lowered. One non-limiting example of such a roller mechanism can be seen in more detail in FIGS. 6 and 7. In addition, a non-limiting example of such a roller mechanism may be found in U.S. patent application Ser. No. 12/976,732, filed Dec. 22, 2010, entitled "Cordless Covering for Architectural Opening." In addition, another suitable roller mechanism is the Fashion Wand product available through Safe-T-Shade, Inc., Huntersville, N.C.

Referring again to FIG. 3, in one embodiment, a pair of cord guides 78 and 79 may be attached to the head rail 56 to allow a lift cord 64 to be routed through the cord guides 78 and 79 before being accumulated onto the accumulating members 74. The cord guides 78 and 79 provide some slack tolerance for the lift cord 64 as it is being accumulated when the shade 54 is raised and further aid in the lift cord 64 being accumulated without entanglement.

In the exemplary system shown in FIG. 3, instead of accumulating the lift cords 64 directly onto the rod 66, in the embodiment disclosed in FIG. 3, one or more accumulating members 74 can be placed on the rod 66 to accumulate the lift cords 64 used to lift and lower a covering for an architectural opening without entanglement to safely and smoothly raise the shade 54. In general, because lift cords are typically soft and compressible, they do not roll up smoothly like a hose or chain. Often, the lift cord will get entangled or compressed, and the architectural covering will become crooked or will not be able to be raised or lowered. The accumulating members 74 of FIG. 3 address that problem by allowing the lift cords 64 to be accumulated in an orderly manner so they do not become entangled.

In one embodiment, the rod 66 has a square or rectangular shape and the accumulating member 74 has a cone shape with a base portion that conforms to the rod 66 in such a way that as the rod 66 rotates, it contacts a portion of the accumulating member 74 and the accumulating member 74 traverses slightly on the rod 66 as the rod 66 rotates. As the lift cords 64 are actuated to raise or lower the shade 54, the accumulating members 74 traverse slightly along the rod 66 to allow the lift cords 64 to accumulate on the accumulating members 74 in such a way that each lift cord 64 rolls up on its respective accumulating member 74 next to itself rather than on top of itself.

Although three accumulating members 74 are shown in FIG. 3, any number of accumulating members may be used. In one embodiment, there would be one accumulating member 74 for each lift cord 64. In one embodiment, the accumulating members 74 are conical shaped spools and may be grooved or threaded, as can be seen in FIG. 4, and is discussed in more detail below. As the shade 54 is raised, the lift cords 64 accumulate on the grooves or threads of the accumulating members 74 in a uniform manner so that the lift cords 64 do not get entangled and the lift cords 64 function smoothly to allow the shade 54 to be raised in a safe and uniform manner without snagging the lift cords 64. In this manner, the shade 54 can be lifted smoothly without any tilting of the shade to one side or the other. In the reverse process, when the lift cords 64 are actuated to lower the shade 54, because the lift cords 64 have been accumulated on the accumulating members 74 in such a way that each lift cord 64 rolls up on its respective accumulating member 74 next to itself rather than on top of itself, the lift cord 64 can unwind off of the accumulating member 74 smoothly and easily without getting entangled as the shade 54 is lowered.

Figure 4A:
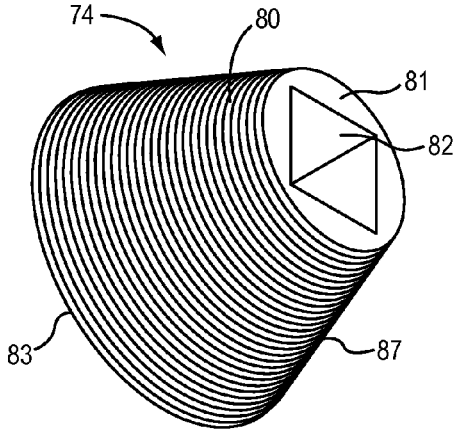
FIG. 4A is a representative front view of an exemplary accumulating member used in one embodiment of an exemplary system for accumulating lift cords used in an exemplary architectural opening covering system.

FIG. 4A is a representative front view of an exemplary accumulating member used in one embodiment of an exemplary system for accumulating lift cords used in architectural opening covering systems.

Figure 4B:
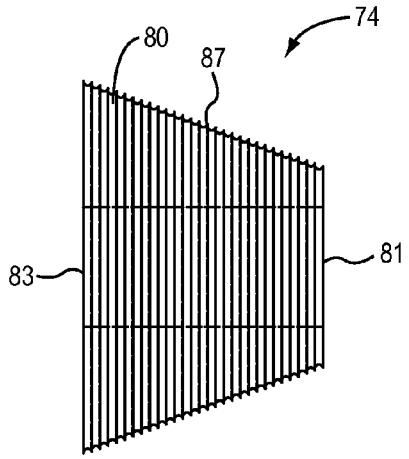
FIG. 4B is a representative side view of the exemplary accumulating member shown in FIG. 4A.

FIG. 4B is a representative side view of the exemplary accumulating member shown in FIG. 4A.

Figure 4C:
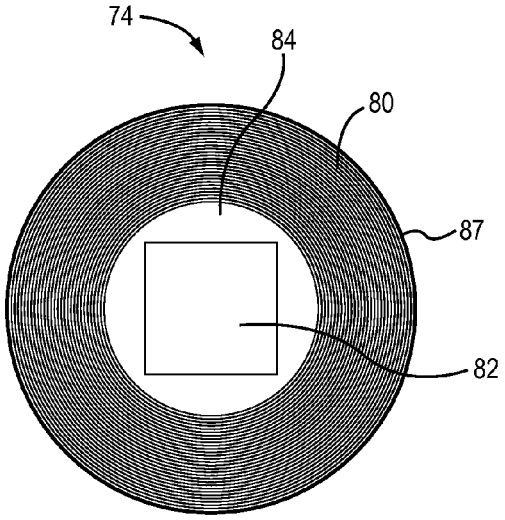
FIG. 4C is a representative top view of the exemplary accumulating member shown in FIGS. 4A and 4B.

FIG. 4C is a representative top view of the exemplary accumulating member shown in FIGS. 4A and 4B.

As seen in FIGS. 4A-4C, an exemplary accumulating member 74 has a series of grooves or threads 80 on an outer surface 87 of the accumulating member 74. In one embodiment, the grooves or threads 80 are non-parallel, which aid in allowing the lift cord 64 to roll up on its respective accumulating member 74 next to itself rather than on top of itself when the shade 54 is raised, and allows the lift cord 64 to smoothly and easily unwind off of the accumulating member 74 without getting entangled as the shade 54 is lowered.

The accumulating member 74 has a base portion 81 with an opening 82 in the base portion 81. The accumulating member 74 has a front portion 83 which is open for the rod 66 to pass through when the accumulating member 74 is slid over the rod 66. The front portion 83 is of a circular shape, as can be seen in the top view of FIG. 4C. In one embodiment, the accumulating member 74 is conical shaped, with a round or circular base portion 81 and a round or circular front portion 83. The outside diameter of the accumulating member 74 narrows from the front portion 83 to the base portion 81. In one embodiment, the accumulating member 74 narrows from approximately one and half (1.5) inches in diameter to approximately one half (0.5) of an inch. The opening 82 in the base portion 81 is of a size and shape that it conforms to the rod 66 and can be slid over the rod 66. One or more accumulating members 74 can be easily slid onto the rod 66 during installation. An inner diameter of an interior 84 of the accumulating member 74 is of a size and shape that conforms to the size and shape of the outer diameter of the rod 66 such that when the rod 66 rotates when actuated by the roller mechanism 76, it contacts a portion of the accumulating member 74 and the accumulating member 74 traverses slightly on the rod 66 as the rod 66 rotates. Although the embodiment in FIG. 3 shows a square rod 66, any shape may be used, as long as the shape of the rod 66 and the shape of the base portion 81 of the accumulating member 74 are chosen such that the accumulating member 74 can be slid onto the rod 66 and when the rod 66 rotates when actuated by the roller mechanism 76, it contacts a portion of the accumulating member 74 and the accumulating member 74 traverses slightly on the rod 66 as the rod 66 rotates.

Figure 5:
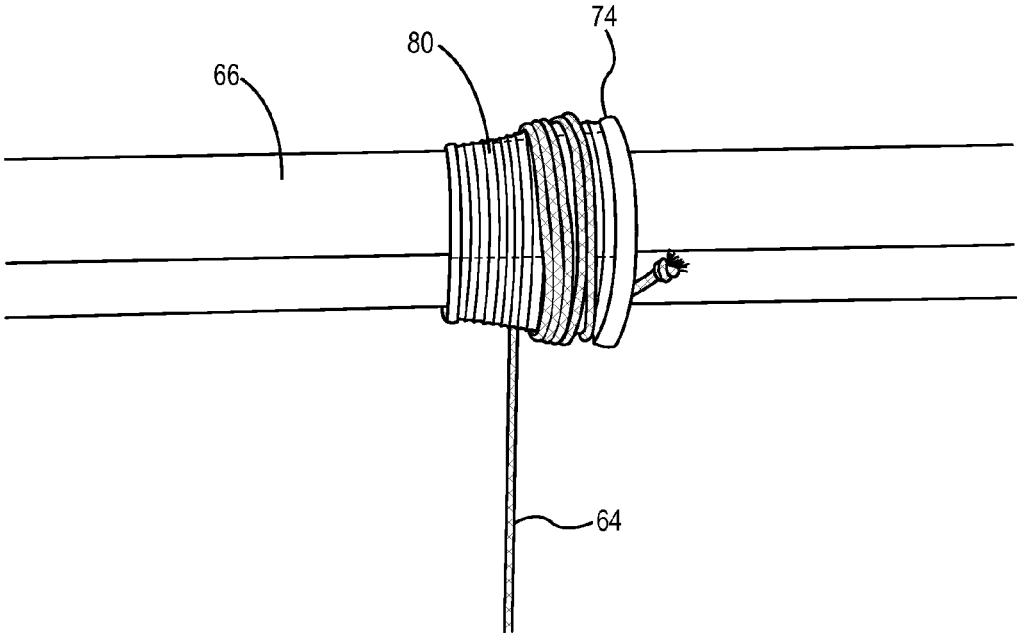
FIG. 5 is a representative close-up view of an exemplary accumulating member accumulating an exemplary lift cord.

FIG. 5 is a representative close-up view of an exemplary accumulating member accumulating an exemplary lift cord. During an installation or assembly process, the accumulating member 74 is slid onto one end of the rod 66 to a desired position. This is easy and simple to do and allows for a much quicker and simpler installation than in prior art lift cord systems. The lift cord 64 is tied onto one end of the accumulating member 74, preferably at the end of the largest diameter of the accumulating member 74. In one embodiment, the accumulating member 74 may have a hole (not shown) through which the lift cord 64 may be inserted and tied off so that the lift cord 64 is tied to one end of the accumulating member 74. As set forth above, the accumulating member 74 has a plurality of grooves or threads 80, which are non-parallel in one embodiment. As the shade 54 is raised, the lift cords 64 accumulate on the grooves or threads 80 of the accumulating members 74 in a uniform manner so that the lift cords 64 do not get entangled. In one embodiment, the grooves or threads 80 are non-parallel, which aid in allowing the lift cord 64 to roll up on its respective accumulating member 74 next to itself rather than on top of itself when the shade 54 is raised, and allows the lift cord 64 to smoothly and easily unwind off of the accumulating member 74 without getting entangled as the shade 54 is lowered. By being accumulated on the grooves or threads 80 of the accumulating members 74, the lift cords 64 function smoothly to allow the shade 54 to be raised in a safe and uniform manner without snagging the lift cords 64. In this manner, the shade 54 can be lifted smoothly without any tilting of the shade to one side or the other.

In the reverse process, when the lift cords 64 are actuated to lower the shade 54, because the lift cords 64 have been accumulated on the accumulating members 74 in such a way that each lift cord 64 rolls up on its respective accumulating member 74 next to itself rather than on top of itself, the lift cord 64 can unwind off of the grooves or threads 80 of the accumulating member 74 smoothly and easily without getting entangled as the shade 54 is lowered.

Referring again to FIG. 5, an inner diameter of the accumulating member 74 is of a size and shape that conforms to the size and shape of the outer diameter of the rod 66 such that when the rod 66 rotates when actuated by the roller mechanism 76, it contacts a portion of the accumulating member 74 and the accumulating member 74 traverses slightly on the rod 66 as the rod 66 rotates. This assists in allowing the lift cord 64 to roll up on the grooves or threads 80 of the accumulating member 74 next to itself rather than on top of itself when the shade 54 is raised, and allows the lift cord 64 to smoothly and easily unwind off of the accumulating member 74 without getting entangled as the shade 54 is lowered.

Figure 6:
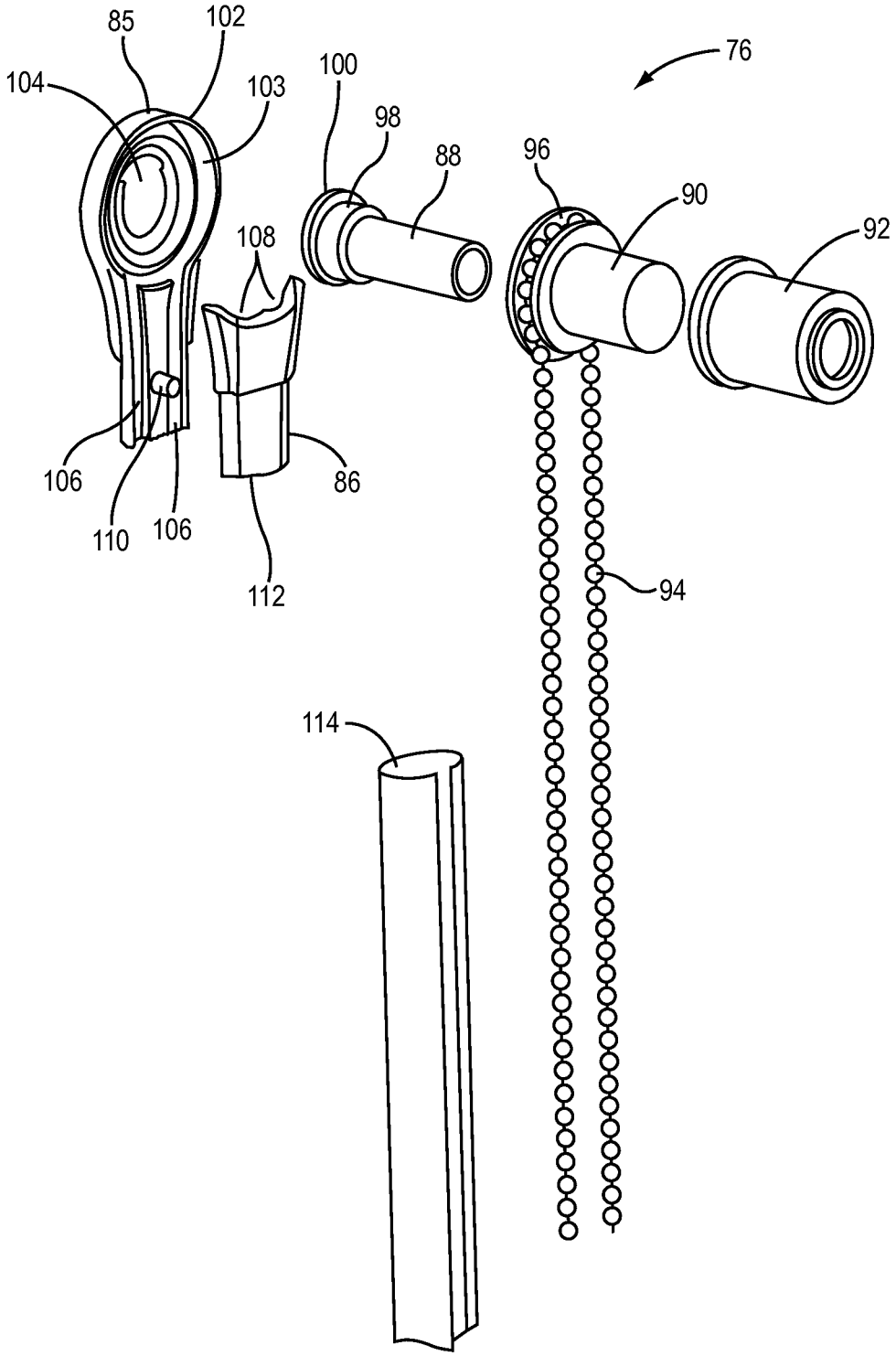
FIG. 6 is an exploded view of an exemplary roller mechanism that may be used in an exemplary system including a plurality of accumulating members for accumulating a cord used to lift and lower a covering for an architectural opening.
Figure 7:
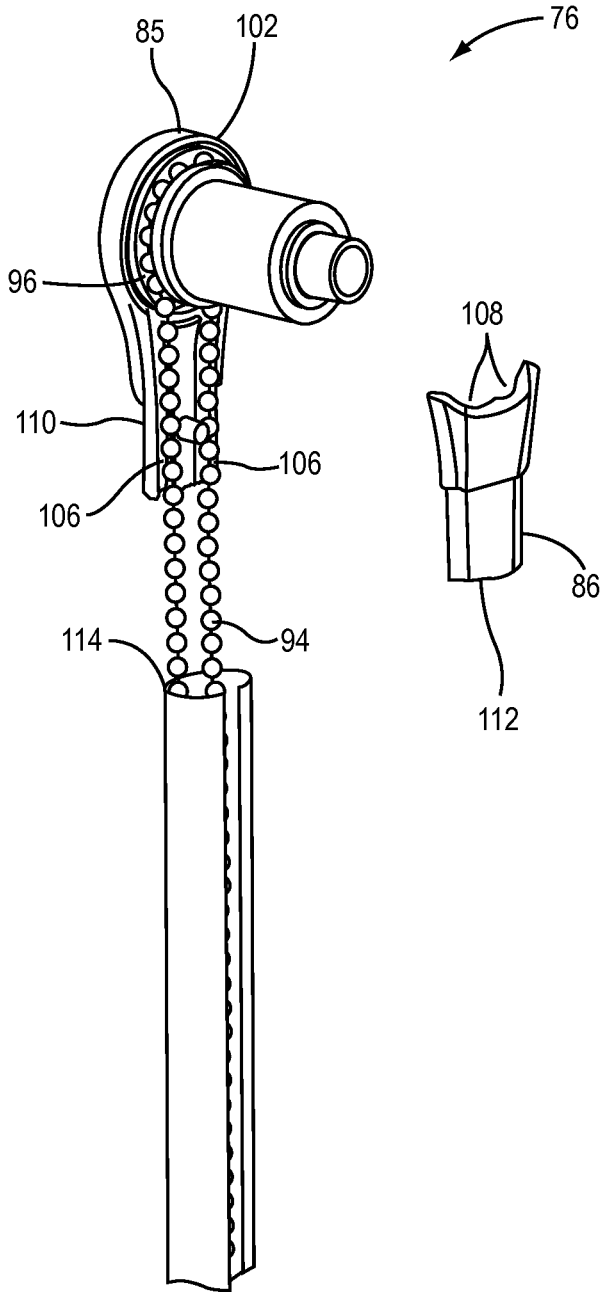
FIG. 7 is a perspective view of the exemplary roller mechanism of FIG. 6 having a cord placed within an engagement chamber.

Any suitable mechanism may be used to actuate the lift cords 64 to raise or lower the shade 54. Referring back to FIG. 3, the mechanism used to actuate the lift cords 64 may comprise a roller mechanism, such as roller mechanism 76, which may include a wand with a clutch mechanism and a continuous beaded chain to actuate the rod 66 to rotate the rod 66 such that the lift cords 64 are actuated and the shade 54 is lifted or lowered. FIGS. 6 and 7 provide more detail for an exemplary roller mechanism that may used with a system that includes the accumulating members disclosed herein to rotate the rod 66 such that the lift cords 64 are actuated and the shade 54 is lifted or lowered.

FIG. 6 is an exploded view of an exemplary roller mechanism that may be used in an exemplary system including a plurality of accumulating members for accumulating a cord used to lift and lower a covering for an architectural opening.

FIG. 7 is a perspective view of the exemplary roller mechanism of FIG. 6 having a cord placed within an engagement chamber.

FIG. 6 illustrates an exploded view of one embodiment of the roller mechanism 76. The roller mechanism 76 may include first and second body portions 85, 86 and first, second, and third hollowed shafts 88, 90, 92. The first hollowed shaft 88 may be narrower than the second and third hollowed shafts 90, 92 but also longer so that it can be inserted into the second and third hallowed shafts 90, 92. Similarly, the second hollowed shaft 90 may be narrower than the third hollowed shaft 92 but also longer to fit within the third hollowed shaft 92. The third hollowed shaft 92 is inserted into, engages, or is integrated with the rod 66 (shown in FIG. 3) so that turning the third hollowed shaft 92 actuates the lift cords 64. A beaded chain 94 may be inserted within a ring channel 96 in the second hollowed shaft 90. The second hollowed shaft 90 thus acts as a pulley for the beaded chain 94 so that actuating the beaded chain 94 turns the second hollowed shaft 90. As discussed above, the second hollowed shaft 90 may be inserted within the third hollowed shaft 92 and thus turning the second hollowed shaft 90 also turns the third hollowed shaft 92 to actuate the rod 66. To connect the first, second, and third hollowed shafts 88, 90, 92 to the first body portion 85, the first hollowed shaft 88 defines an engagement end 98 having a lip 100. A ringed enclosure 102 having an opening 104 is provided within an engagement chamber 103 of the first body portion 85. The lip 100 may be inserted through the opening 104 and into the ringed enclosure 102 to thereby connect the first, second, and third hollowed shafts 88, 90, 92. The first, second, and third hollowed shafts 88, 90, 92 may provide sufficient friction to prevent the rod 66 from being turned when the beaded chain 94 is intended to be actuated.

Referring now to FIGS. 6 and 7, the engagement chamber 103 also houses the beaded chain 94 to prevent the beaded chain 94 in the ring channel 96 from being exposed. The first and second body portion 85, 86 may also each include a pair of guide channels 106, 108 that guide the beaded chain 94 and prevent the beaded chain 94 from becoming tangled. Each of the first and second body portions 85, 86 may also have insertable ends 110, 112. The first and second body portions 85, 86 engage one another and their insertable ends 110, 112 are placed within a first end 114 of the roller mechanism 76. In this manner, the beaded chain 94 is not exposed by the roller mechanism 76.

Referring now to FIGS. 3, 6, and 7, in one embodiment, the third hollowed shaft 92 of the roller mechanism 76 fits inside one end (see, e.g., second end 70 in FIG. 3) of the rod 66. The second end 70 of the rod 66 may be square or some other non-round shape that allows a portion of the roller mechanism 76 to be inserted into the second end 70 of the rod 66 such that when the roller mechanism 76 is actuated, the rod 66 is rotated and the lift cords 64 are actuated to raise the shade 54. When the roller mechanism 76 is actuated to raise the shade 54, the rod 66 is rotated, and the accumulating member 74 traverses a slight distance along the rod 66, and the lift cord 64 rolls up on the grooves or threads 80 of the accumulating member 74 next to itself rather than on top of itself. When the roller mechanism 76 is actuated to lower the shade 54, the rod 66 rotates in the opposite direction, and the lift cord 64 smoothly and easily unwinds off of the accumulating member 74 without getting entangled as the shade 54 is lowered.

In this manner, by use of the accumulating members disclosed herein, lift cords used to raise and lower the covering for an architectural opening can be accumulated without entanglement so that the window covering can be safely and smoothly raised and lowered. In addition, because the accumulating members allow for a smooth and efficient accumulating of the lift cords, window openings may be raised and lowered without creating a hazardous loop.

Although the embodiments disclosed herein may have been discussed with respect to a shade as the architectural opening covering, the accumulating members disclosed herein can likewise be used with other architectural opening covering systems that include lift cords of any type, including but not limited to blind systems.

Although the embodiments disclosed herein have been illustratively described with respect to various embodiments for window openings or other architectural openings, it will be recognized that the cover assembly can be advantageously utilized as a covering for any indoor or outdoor passage, portal, gate opening, or the like. For example, the cover assembly in other embodiments can be used as a closure for a tent or cabana or a decorative screen or partition that may be deployed with an associated frame, to provide a freestanding room divider, privacy screen, sun-blocking structure, or the like.

While the embodiments disclosed herein have been described herein in reference to specific aspects, features, and illustrative embodiments, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

Those skilled in the art will recognize improvements and modifications to the preferred embodiments of the present disclosure. All such improvements and modifications are considered within the scope of the concepts disclosed herein and the claims that follow.

What is claimed is:

1. An apparatus for accumulating one or more lift cords used to lift an architectural opening covering comprising:
   - a base portion having an opening disposed therein, the opening configured to receive a rod that rotates in a first direction when the one or more lift cords are actuated to raise the architectural opening covering, and wherein the opening disposed in the base portion is of a size and shape that conforms to the size and shape of the rod such that when the rod rotates in the first direction, a portion of the apparatus selectively contacts the rod and the apparatus traverses freely a distance along the rod;
   - a front portion having a diameter larger than a diameter of the base portion such that the diameter of the apparatus narrows from the front portion to the base portion; and
   - an outer surface having a plurality of grooves,
   - wherein the plurality of grooves are configured to receive at least one of the one or more lift cords when the one or more lift cords are actuated to raise the architectural opening covering and to allow the at least one of the one or more lift cords to accumulate on one or more of the plurality of grooves next to itself rather than on top of itself.

2. The apparatus of claim 1, wherein the plurality of grooves are not parallel to one another.

3. The apparatus of claim 1, wherein the apparatus is conical shaped.

4. The apparatus of claim 1, wherein the diameter of the front portion is approximately one and a half (1.5) inches and the diameter of the base is approximately one half (0.5) inches.

5. The apparatus of claim 1, wherein the opening is square shaped.

6. The apparatus of claim 1, further comprising a hole at the first end of the apparatus through which at least one of the one more lift cords may be inserted and tied off to attach the at least one of the one or more lift cords to the first end of the apparatus.

7. The apparatus of claim 1, wherein the base portion and the front portion are configured such that the apparatus can be slid onto the rod during an installation process.

8. The apparatus of claim 1, wherein the plurality of grooves are configured to allow an accumulated lift cord to freely unwind from the plurality of grooves when the rod rotates in a second direction opposite from the first direction when the one or more lift cords are actuated to lower the architectural opening covering.

9. A system for accumulating one or more lift cords used to lift an architectural opening covering comprising:
   - a head rail;
   - an architectural opening covering attached to the head rail;
   - one or more lift cords configured to lift the architectural covering;
   - a rod having a first end and a second end positioned under the head rail; and
   - one or more accumulating members configured to be positioned on the rod,
   - wherein the one or more accumulating members each has an outer surface having a plurality of grooves configured to receive at least one of the one or more lift cords when the one or more lift cords are actuated to raise the architectural opening covering and to allow the at least one of the one or more lift cords to accumulate on one or more of the plurality of grooves next to itself rather than on top of itself; and wherein the accumulating member comprises a base portion having an opening disposed in the base portion that is of a size and shape that conforms to the size and shape of the rod such that when the rod rotates in the first direction, a portion of the accumulating member selectively contacts the rod and the accumulating member traverses freely a distance along the rod.

10. The system of claim 9, wherein the plurality of grooves are not parallel to one another.

11. The system of claim 9, wherein at least one of the one or more accumulating members is conical shaped.

12. The system of claim 9, wherein each of the one or more accumulating members comprise:

a front portion having a diameter larger than a diameter of the base portion such that an inner diameter of the accumulating member narrows from the front portion to the base portion.

13. The system of claim 12, wherein the diameter of the front portion is approximately one and a half (1.5) inches and the diameter of the base is approximately one half (0.5) inches.

14. The system of claim 12, wherein the opening is square shaped and the rod is square shaped.

15. The system of claim 12, wherein the base portion and the front portion are configured such that the apparatus can be slid onto the rod during an installation process.

16. The system of claim 9, wherein the plurality of grooves are configured to allow an accumulated lift cord to freely unwind from the plurality of grooves when the rod rotates in a second direction opposite from the first direction when the one or more lift cords are actuated to lower the architectural opening covering.

17. The system of claim 9, further comprising a pair of brackets, one of the pair of brackets attached to opposite ends of the head rail.

18. The system of claim 9, further comprising a pair of brackets, the pair of brackets integrally formed as part of the head rail at opposite ends of the head rail.

19. The system of claim 17, wherein the rod is connected to the head rail by being attached to the pair of brackets.

20. The system of claim 9, further comprising one or more support brackets to help support the rod.

21. The system of claim 20, wherein a shape of the support brackets is selected from group consisting of U-shaped, C-shaped, J-shaped, and horseshoe shaped.

22. The system of claim 9, further comprising a roller mechanism to actuate the rod and the one or more lift cords to raise or lower the architectural opening covering.

23. The system of claim 22, wherein the roller mechanism comprises a clutch mechanism and a continuous beaded chain.

24. The system of claim 9, further comprising one or more cord guides attached to the head rail to allow the one or more lift cords to be routed through the one or more cord guides before being accumulated on the one or more accumulating members.

* * * * *